United States Patent [19]

Barnes, Jr. et al.

[11] Patent Number: 4,961,245

[45] Date of Patent: Oct. 9, 1990

[54] SUCTION CONTROLLING ARRANGEMENT IN A CANISTER VACUUM CLEANER

[75] Inventors: James F. Barnes, Jr., Anderson; Roy H. Herron, Jr., Starr; Steven K. Hughes, Honea Path, all of S.C.

[73] Assignee: Ryobi Motor Products Corp., Pickens, S.C.

[21] Appl. No.: 475,392

[22] Filed: Feb. 5, 1990

[51] Int. Cl.[5] ..... A47L 9/00

[52] U.S. Cl. ..... 15/339; 15/421

[58] Field of Search ..... 15/421, 375, 339

[56] References Cited

U.S. PATENT DOCUMENTS

| | | | |
|---|---|---|---|
| 2,176,319 | 10/1939 | Lofgren | 15/421 X |
| 2,978,733 | 4/1961 | Wahlborg | 15/421 |
| 3,048,876 | 8/1962 | Kemnitz | 15/421 X |

FOREIGN PATENT DOCUMENTS

| | | | |
|---|---|---|---|
| 1086685 | 8/1954 | France | 15/421 |

*Primary Examiner*—Chris K. Moore

*Attorney, Agent, or Firm*—David L. Davis

[57] ABSTRACT

The handle section of a canister vacuum cleaner hose is formed with a noise reducing bleed hole shaped with an inwardly converging wall on the side directed toward the nozzle end of the wand.

2 Claims, 1 Drawing Sheet

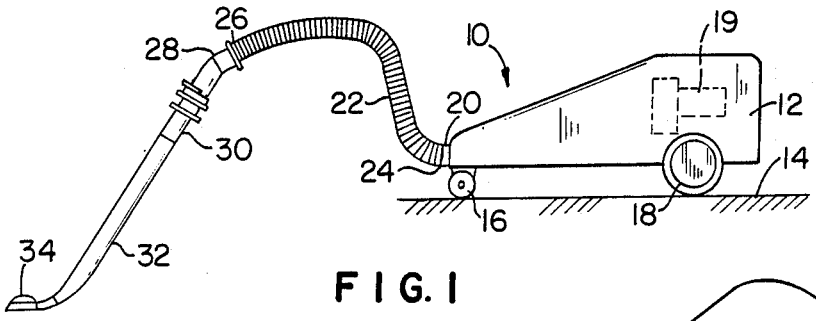
FIG. 1
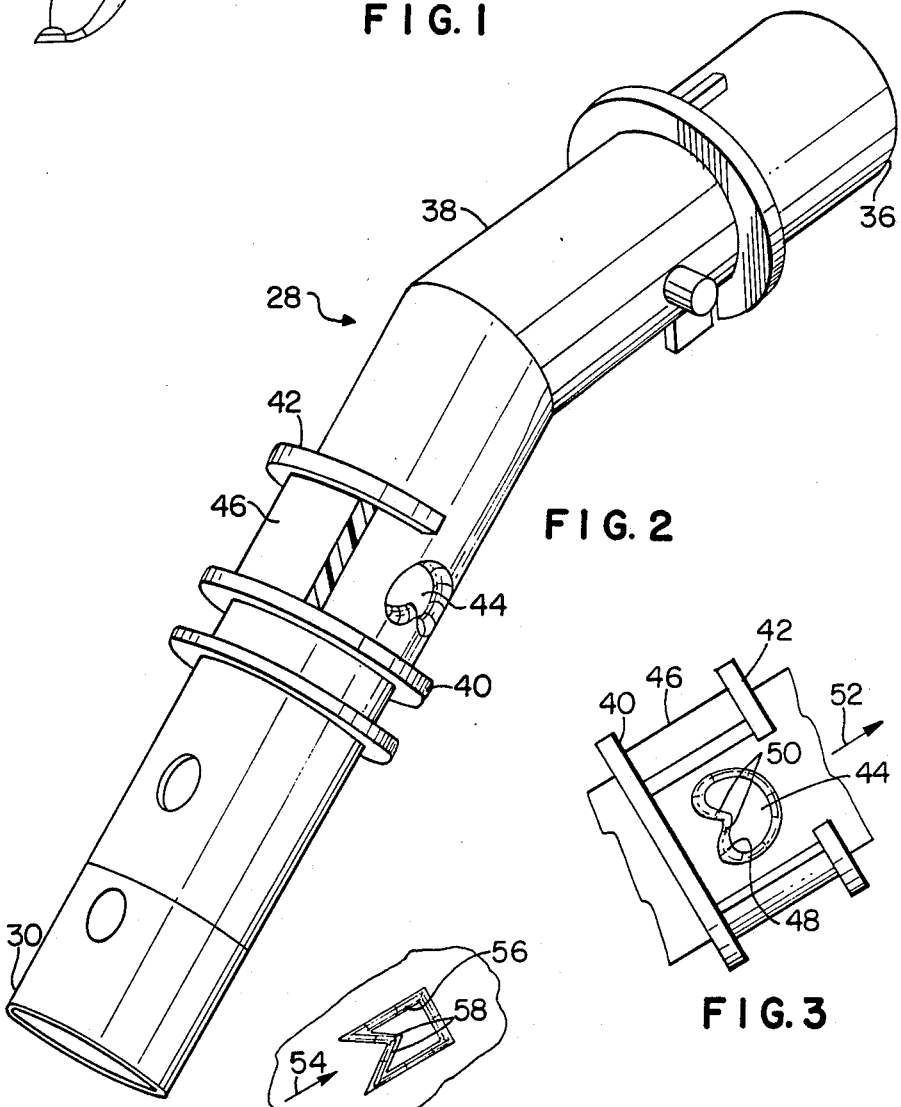
FIG. 2
FIG. 3
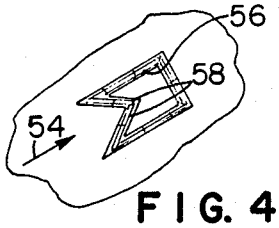
FIG. 4

SUCTION CONTROLLING ARRANGEMENT IN A CANISTER VACUUM CLEANER

BACKGROUND OF THE INVENTION

This invention relates to vacuum cleaners and, more particularly, to an improved arrangement for controlling the suction at the nozzle of a canister vacuum cleaner.

Canister vacuum cleaners typically include a chassis member, supported on a floor surface by means of wheels or runners, which includes therein a motor/-blower unit for producing suction at an inlet port. A flexible hose has a first end connected to the inlet port and a second end connected to a rigid handle section. At the other end of the handle section, there is connected an elongated wand which has a floor cleaning nozzle connected to the end remote from the handle section. The wand and floor cleaning nozzle can be replaced by other tools, such as for example, a crevice tool, an upholstery nozzle, or a drapery cleaning nozzle.

It is often desirable to be able to control the amount of suction at the nozzle, depending upon the cleaning operation being performed. One way of controlling the suction is to control the speed of the motor producing the suction. However, to provide an arrangement whereby the operator controls the speed of the motor results in increased complexity and resultant cost of the vacuum cleaner. Accordingly, it has become common for vacuum cleaner manufacturers to provide a bleed hole in the handle section along with a movable cover partially encircling the handle section which the operator can rotate to expose all, part or none of the bleed hole so as to selectively divert suction from the nozzle. This is a far less costly approach than controlling the speed of the motor. However, an opening in a wall surrounding a fast moving air stream, as above described, produces noise which is an irritant to the vacuum cleaner operator.

Accordingly, it is a primary object of this invention to provide an arrangement for controlling the suction at the nozzle of a canister vacuum cleaner without the attendant noise irritant.

SUMMARY OF THE INVENTION

The foregoing and additional objects are attained in accordance with the principles of this invention by providing an arrangement for controlling the suction at the nozzle of a canister vacuum cleaner which includes providing a bleed hole so configured that its shape minimizes the noise produced as a result of the air flowing thereby. In particular, the bleed hole is shaped with an inwardly converging wall on the side directed toward the nozzle. Preferably, the bleed hole is generally heart shaped.

BRIEF DESCRIPTION OF THE DRAWINGS

The foregoing will be more readily apparent upon reading the following description in conjunction with the drawings in which like elements in different figures thereof have the same reference numeral applied thereto and wherein:

FIG. 1 illustrates a canister vacuum cleaner in which an arrangement constructed in accordance with the principles of this invention may be incorporated;

FIG. 2 is a perspective view of the handle section of the vacuum cleaner of FIG. 1 incorporating the present invention;

FIG. 3 is an elevational view of the handle section shown in FIG. 2 illustrating in detail a bleed hole designed according to this invention; and FIG. 4 illustrates an alternate shape for the bleed hole.

DETAILED DESCRIPTION

FIG. 1 illustrates a canister vacuum cleaner designated generally by the reference numeral 10, having a chassis member 12 supported on a floor surface 14 by wheels 16, 18 and containing therein a conventional motor/blower unit 19 for producing suction at an inlet port 20. A flexible hose 22 is connected at a first end 24 to the inlet port 20 and has connected at its second end 26 a handle section 28. The handle section 28 is connected at its other end 30 to an elongated wand 32 which has a nozzle 34 connected to its distal end.

FIG. 2 is a perspective view showing the handle section 28 in which an illustrative bleed hole shaped according to this invention is incorporated. The handle section 28 is a rigid generally tubular hollow member having an end 30 for connection to the wand 32, or to some other cleaning tool, and an end 36 for connection to the hose 22. The handle section 28 is preferably bent so that the operator can maintain a comfortable grip in the region 38 while the end 30 is pointed toward the floor surface being cleaned. Between the ends 30 and 36, the handle section 28 is formed with a pair of radially extending and spaced apart flanges 40 and 42. In the region between the flanges 40, 42 a bleed hole 44 extends through the wall of the handle section 28 to provide fluid communication between the interior of the handle section 28 and the ambient atmosphere.

The bleed hole 44 diverts suction produced by the motor/blower unit 19 within the chassis member 12 from the nozzle 34. In order to control the amount of suction diverted from the nozzle 34, there is provided a movable cover member 46 partially encircling the handle section 28 in the region between the flanges 40 and 42. As is conventional, the movable cover element 46 extends circumferentially around the handle section 28, covering an arc of at least 180° so that the cover element 46 remains on the handle section 28 of its own accord, but leaving a gap having an extent at least equal to the largest circumferential dimension of the bleed hole 44. In this manner, the operator can choose to expose as much of the bleed hole 44 as is desired so as to selectively control diversion of suction from the nozzle 34 between the limits of substantially no diversion (when the bleed hole 44 is completely covered) and the maximum diversion afforded when the bleed hole 44 is completely exposed.

The flow of air through the handle section 28 produced by the motor/blower 19 unit within the chassis member 12 produces noise as it passes the bleed hole 44. It has been discovered that this noise is substantially reduced if the shape of the wall defining the bleed hole 44 is configured with an inwardly converging wall on the side directed toward the nozzle 34. Thus, as shown in FIG. 3, the wall 48 defining the bleed hole 44 has an inwardly converging portion 50 on the side directed toward the nozzle 34. Thus, the flow of air in the direction indicated by the arrow 52 is in the same direction as the converging portion 50, which results in reduced noise generation.

As shown in FIG. 3, a preferred shape for the bleed hole 44 is heart shaped. However, other shapes having inwardly converging walls on the side directed toward the nozzle 34 also result in noise reduction. For example, the substantially rectangular bleed hole shape shown in FIG. 4, where the air flow is in the direction of the arrow 54, also results in reduced noise. Thus, the bleed hole shown in FIG. 4 has a wall 56 with an inwardly converging portion 58 on the side directed toward the nozzle 34.

Accordingly, there has been disclosed an improved arrangement for controlling the suction at the nozzle of a canister vacuum cleaner. While illustrative embodiments of the present invention have been disclosed herein, it will be apparent to those of ordinary skill in the art that various modifications and adaptations to those embodiments are possible and it is only intended that the present invention be limited by the scope of the appended claims.

I claim:

1. In a vacuum cleaner appliance having means for producing suction, a nozzle, and a conduit between said nozzle and said suction producing means, said conduit including a generally tubular hollow rigid handle section in line therewith, means for selectively controlling suction at said nozzle comprising:

means for providing fluid communication between said conduit and the ambient atmosphere, said fluid communication providing means including an aperture through said handle section, said aperture being shaped with an inwardly converging wall on the side directed toward said nozzle; and means for controlling the exposure of said aperture.

2. The suction controlling means according to claim 1 wherein said aperture is generally heart shaped.

* * * * *